United States Patent [19]

Henych

[11] 4,382,828

[45] May 10, 1983

[54] CHROMIUM CAST IRON AND METHOD OF PRODUCING SAME

[75] Inventor: Ivo Henych, Schaffhausen, Switzerland

[73] Assignee: George Fischer Limited, Switzerland

[21] Appl. No.: 207,997

[22] Filed: Nov. 18, 1980

[30] Foreign Application Priority Data

Nov. 19, 1979 [CH] Switzerland ..... 10291/79

[51] Int. Cl.[3] ..... C21D 5/00; C21D 5/04

[52] U.S. Cl. ..... 148/3; 148/35; 148/138

[58] Field of Search ..... 148/35, 138, 3; 75/126 A, 123 CB

[56] References Cited

U.S. PATENT DOCUMENTS

| | | | |
|---|---|---|---|
| 3,410,682 | 11/1968 | Avery et al. | 148/35 |
| 3,623,922 | 11/1971 | Williams | 148/35 |
| 3,784,416 | 1/1974 | Davies | 148/138 |
| 3,941,589 | 3/1976 | Norman et al. | 148/35 |
| 3,961,994 | 6/1976 | Thome | 148/35 |
| 4,043,842 | 8/1977 | Joiret | 148/35 |
| 4,194,906 | 3/1980 | Krantz et al. | 148/35 |

FOREIGN PATENT DOCUMENTS

| | | | |
|---|---|---|---|
| WO79/274 | 5/1979 | Switzerland | 148/35 |

*Primary Examiner*—Peter K. Skiff

*Attorney, Agent, or Firm*—Roylance, Abrams, Berdo & Farley

[57] ABSTRACT

White, chromium cast iron having shock and impact resistance which comprise iron together with:

| | | |
|---|---|---|
| Carbon: | 2.2 to 3.6% | by weight |
| Chromium: | 12.0 to 30.0% | by weight |
| Molybdenum: | 0.0 to 3.0% | by weight |
| Nickel: | 0.0 to 3.0% | by weight |
| Manganese: | 0.0 to 2.0% | by weight |
| Copper: | 0.0 to 3.0% | by weight |
| Vanadium: | 0.0 to 1.5% | by weight |

are disclosed. The casting are produced by casting the molten alloy in a metallic permanent mold, removing the solidified casting from the mold at a temperature above the $A_{c3}$ temperature and cooling the casting sufficiently quickly to prevent the formation of pearlite as well as secondary carbide precipitation.

8 Claims, No Drawings

CHROMIUM CAST IRON AND METHOD OF PRODUCING SAME

BACKGROUND OF THE INVENTION

1. Field of the Invention

The invention relates to cast parts having high impact and wear resistance made of white, at least predominantly austenitic, chromium cast iron, and to the process for producing cast chromium containing white irons which have high impact and wear resistance.

2. Description of the Prior Art

It is known to provide wearing parts which are exposed to high abrasion and impact wear from chromium cast iron, as disclosed in, for example, DIN 1695, BSI 4844, Part 3, ASTM A532-A and others.

The chemical composition of alloys described in the above specifications are usually within the following limits, wherein the values listed are percent by weight:

| | |
|---|---|
| Carbon: | 2.2 to 3.6% |
| Silicon: | 0.4 to 1.5% |
| Manganese: | 0.4 to 1.0% |
| Nickel: | 0.2 to 2.0% |
| Chromium: | 12.0 to 28.0% |
| Molybdenum: | 0.0 to 3.0% |
| Vanadium: | 0.0 to 1.0% |

In the casting state, the basic mass consists of austenite and martensite with 10 to 50%, by weight, pearlite. The eutectic or primary carbides present, as determined by chemical analysis, which are embedded in the basic mass, constitute 18 to 40% of the structure.

As a result of the presence of pearlite or of secondary carbides, this basic mass is brittle and the endurance impact resistance as well as the abrasion resistance are low. By tempering, the basic mass is converted into martensite and the characteristics of impact resistance, abrasion resistance and the like, are improved. In the heat processed state, i.e., after hardening and single or multiple tempering and unstressing treatments, with the goal of reducing the residual austenite content, the hardness is increased and the endurance impact resistance is improved. The latter, however, still amounts to only a fraction of that which is known, for example, of the austenitic manganese steel, and consequently an occasional failure of the wearing parts occurs in operation. The operational fracture of wearing parts leads not only to a shut-down of equipment, e.g., a crusher, but sometimes to damage of the machinery itself. From the reported literature and laboratory experiments (for example, Kulmburg, Staska; Working Material Technique; 73, No. 1, pages 41–49: Diesburg, Borik; Symposium for the Mining Industry, Colorado, June 30, 1974, pages 15–41, etc.), it has been known that austenitic white chromium cast iron or cold-tough steels have good wearing characteristics and outstanding $KI_c$ (fracture resistance) values. The production of such structures, however, have been possible previously only by tempering from temperatures above 1100° C. These high temperature tempering treatments cannot be profitably achieved, however, through the use of average furnaces.

It is an object of the invention to provide a process for producing cast parts having high impact and and wear resistance.

It is an object of the invention to provide predominantly austenitic chromium cast iron exhibiting, even in the cast state, an impact and wear resistance which will be sufficient for the parts, for example, of a crusher, exposed to shock and impact wear.

SUMMARY OF THE INVENTION

The invention provides cast iron parts with high impact resistance and abrasion resistance made of white, at least predominantly austenitic, chromium cast iron, which has alloy components of:

| | | |
|---|---|---|
| Carbon: | 2.2 to 3.6% | by weight |
| Chromium: | 8.0 to 30.0% | by weight |
| Molybdenum: | 0.0 to 3.0% | by weight |
| Nickel: | 0.0 to 6.0% | by weight |
| Manganese: | 0.0 to 2.0% | by weight |
| Copper: | 0.0 to 3.0% | by weight |
| Vanadium: | 0.0 to 1.5% | by weight |

The cast white iron parts are further characterized in that the composition is free of pearlite and secondary carbide precipitations.

The invention provides a process for the production of these cast parts according to which the parts are cast in a mold and are unpacked or removed from the mold and sand while the surface temperature of the cast part is above the $A_{c3}$ conversion temperature of the particular alloy, and the subsequent cooling of the cast part is of a speed sufficiently great to prevent the formation of pearlite and secondary carbide precipitation.

DETAILED DESCRIPTION OF THE INVENTION

In carrying out the invention, it is important that the cast part after removal from the casting mold be cooled at a sufficiently high rate to form a predominantly austenitic structure free of pearlite or secondary carbides.

The casting process takes place at a temperature of about 1400° C., and unpacking or removal from the metal mold is accomplished at a temperature of about 900° C., advantageously above 1000° C. and in any case above the $A_{c3}$ conversion temperature, which is also known as the alpha-gamma conversion temperature or the temperature where transformation from gamma to alpha iron takes place. The $A_{c3}$ temperature for particular alloys is well known to those skilled in the art.

After removal of the cast part from the mold, the cooling-off speed must be controlled such that no secondary carbide precipitations with resultant destabilization of the austenite, and no pearlite development, can take place.

The cross-section of cast parts may vary greatly and because of the variance, it may be necessary to adjust the cooling off rate. Where the cast part is of a relatively small cross-section up to 50 mm, a cooling rate of about 15° C. per minute is suitable. Where the cast part has a relatively large cross-section above 50 mm, a cooling rate as low as about 8° C. per minute is suitable. The cooling may be advantageously conducted in quiescent or moving air or advantageously in a salt bath or in oil.

It must be noted that the allowable variation in the rate of cooling in some instances has limits due to heat conductivity, stress build-up, danger of cracks and the like, so that it may be necessary with certain cast parts depending on e.g., wall thickness, to cool at a lesser rate than would be necessary for the prevention of pearlite formation or of secondary carbide precipitation. In such instances, it will be necessary to modify the alloy composition in order to use an alloy composition having a time-temperature transformation curve which permits a lesser cooling off rate without thereby entering into the pearlite transformation area. Those skilled in the art will readily know how to thus modify the alloy composition with reference to publications of time-temperature transformation curves for various alloy compositions.

In one advantageous embodiment of the invention, the alloy will consist essentially of iron and the following components:

| | | |
|---|---|---|
| Carbon: | 2.4 to 3.4% | by weight |
| Silicon: | 0.4 to 0.9% | by weight |
| Manganese: | 0.4 to 1.5% | by weight |
| Chromium: | 14.0 to 16.0% | by weight |
| Molybdenum: | 2.0 to 3.0% | by weight |
| Vanadium: | 0.0 to 1.0% | by weight |
| Copper: | 0.0 to 2.0% | by weight |

In another advantageous embodiment of the invention, the alloy will consist essentially of iron and the following components:

| | | |
|---|---|---|
| Carbon: | 2.4 to 3.4% | by weight |
| Silicon: | 0.4 to 0.9% | by weight |
| Manganese: | 0.4 to 1.5% | by weight |
| Chromium: | 14.0 to 16.0% | by weight |
| Molybdenum: | 0.0 to 1.0% | by weight |
| Nickel: | 1.0 to 3.0% | by weight |
| Vanadium: | 0.0 to 1.0% | by weight |
| Copper: | 0.0 to 2.0% | by weight |

In another advantageous embodiment of the invention, the alloy will consist essentially of iron together with the following components:

| | | |
|---|---|---|
| Carbon: | 2.4 to 3.4% | by weight |
| Silicon: | 0.4 to 0.9% | by weight |
| Manganese: | 0.4 to 2.0% | by weight |
| Chromium: | 18.0 to 22.0% | by weight |
| Molybdenum: | 0.5 to 3.0% | by weight |
| Nickel: | 0.0 to 3.0% | by weight |
| Vanadium: | 0.0 to 1.0% | by weight |
| Copper: | 0.0 to 2.0% | by weight |

In another advantageous embodiment, the alloy composition will consist essentially of iron together with the following components:

| | | |
|---|---|---|
| Carbon: | 2.4 to 3.4% | by weight |
| Silicon: | 0.4 to 0.9% | by weight |
| Manganese: | 0.4 to 2.0% | by weight |
| Chromium: | 22.0 to 26.0% | by weight |
| Molybdenum: | 0.0 to 3.0% | by weight |
| Nickel: | 0.0 to 3.0% | by weight |
| Vanadium: | 0.0 to 1.0% | by weight |
| Copper: | 0.0 to 2.0% | by weight |

The cast articles may be unstressed after cooling by treatment at temperatures up to the temperature causing any changes to the austenite, i.e., where de-stabilization by secondary carbide precipitation takes place, preferably at a temperature in the range of about 200° C. to about 300° C. Such stress relieving treatment is accomplished after cooling of the cast part to ambient temperature.

The following examples are illustrative of the invention

EXAMPLE 1

Alloy DIN G-X 300 CrMo 15 3 (15%, Cr, 3% C, 2% Mo). Casting is conducted in a permanent metallic mold. Immediately after the cast part solidifies at a temperature of about 1000° C. it is taken out of the mold. Cooling off is conducted by exposing the part to air or moving air having a temperature of up to at least 200° C. The cooling off speed between 1000° and 500° C. is conducted at 15° C. per minute. The cast parts can be treated with a stress releasing treatment at about 250° C. after cooling in air or, if desired, may be subjected to no stress relieving treatment.

EXAMPLE 2

Alloy DIN G-X 260 Cr 27 (25% Cr, 3% C, 1% Mo). Casting is conducted in a permanent metal mold. After the cast part has solidified at a temperature of about 1020°-1050° C. the cast part is removed from the mold and cooled. For smaller cross-sections, up to 50 mm cooling is conducted in air at a rate of about 15° C. per minute. For larger cross-sections above 50 mm, cooling is controlled at a rate of about 8° C. per minute. A stress relieving treatment at about 250° C. with air or furnace cooling may be conducted or, if desired, the cast part may be used without a stress relieving treatment.

Repeated impact tests have shown that the wearing parts which have been produced according to this process, have an excellent repeated impact strength. Wear-tests with pin tests have produced the following results:

| | | |
|---|---|---|
| DIN G-X 260 Cr 27 | in the cast condition | 58 g. abrasion-loss/garnet |
| | hot treated | 66 g. abrasion-loss/garnet |
| DIN G-X 300 CrMo 15 3 | in the cast condition | 44 g. abrasion-loss/garnet |
| | hot treated | 46 g. abrasion-loss/garnet |

Although the invention has been described in considerable detail with specific reference to certain preferred embodiments thereof, variations and modifications can be made without departing from the invention as described in the foregoing specification and defined in the appended claims.

What is claimed is:

1. The process for the production of cast parts with high impact resistance and abrasion resistance made of white, at least predominantly austenitic, chromium cast iron which has alloying components of:

| | | |
|---|---|---|
| Carbon: | 2.2 to 3.6% | by weight |
| Chromium: | 8.0 to 30.0% | by weight |
| Molybdenum: | 0.0 to 3.0% | by weight |
| Nickel: | 0.0 to 6.0% | by weight |
| Manganese: | 0.0 to 2.0% | by weight |
| Copper: | 0.0 to 3.0% | by weight |
| Vanadium: | 0.0 to 1.5% | by weight |

the cast part having a structure free of pearlite and secondary carbide precipitations, wherein the alloy is cast in a mold and allowed to solidify, the resultant casting is removed from the mold at a temperature above the $A_c3$ temperature of the alloy;

and the resultant casting is cooled at a rate sufficiently rapid to prevent the formation of pearlite and secondary carbide precipitations.

2. The process of claim 1 wherein the cast part after removal from the mold is cooled in quiescent or moving air at a rate of about 15° C. per minute for small cross-sectional castings and at a rate of about 8° C. per minute for large cross-sectional castings.

3. The process of claim 1 wherein the cast part after removal from the mold is cooled in a salt bath or in oil.

4. The process of claims 1, 2 or 3 wherein the cast part is cooled to ambient temperature and thereafter is treated for stress relieving at a temperature of between about 200° and about 300° C., said temperature being below the temperature for precipitation of secondary carbides.

5. A process as defined in claim 1 wherein the alloy components consist essentially of iron together with:

| | |
|---|---|
| Carbon: | 2.4 to 3.4% by weight |
| Silicon: | 0.4 to 0.9% by weight |
| Manganese: | 0.4 to 1.5% by weight |
| Chromium: | 14.0 to 16.0% by weight |
| Molybdenum: | 2.0 to 3.0% by weight |
| Vanadium: | 0.0 to 1.0% by weight |
| Copper: | 0.0 to 2.0% by weight |

6. A process as defined in claim 1 wherein the alloy components consist essentially of iron together with:

| | |
|---|---|
| Carbon: | 2.4 to 3.4% by weight |
| Silicon: | 0.4 to 0.9% by weight |
| Manganese: | 0.4 to 1.5% by weight |
| Chromium: | 14.0 to 16.0% by weight |
| Molybdenum: | 0.0 to 1.0% by weight |
| Nickel: | 1.0 to 3.0% by weight |
| Vanadium: | 0.0 to 1.0% by weight |
| Copper: | 0.0 to 2.0% by weight |

7. A process as defined in claim 1 wherein the alloy components consist essentially of iron together with:

| | |
|---|---|
| Carbon: | 2.4 to 3.4% by weight |
| Silicon: | 0.4 to 0.9% by weight |
| Manganese: | 0.4 to 2.0% by weight |
| Chromium: | 18.0 to 22.0% by weight |
| Molybdenum: | 0.5 to 3.0% by weight |
| Nickel: | 0.0 to 3.0% by weight |
| Vanadium: | 0.0 to 1.0% by weight |
| Copper: | 0.0 to 2.0% by weight |

8. A process as defined in claim 1 wherein the alloy components consist essentially of iron together with:

| | |
|---|---|
| Carbon: | 2.4 to 3.4% by weight |
| Silicon: | 0.4 to 0.9% by weight |
| Manganese: | 0.4 to 2.0% by weight |
| Chromium: | 22.0 to 26.0% by weight |
| Molybdenum: | 0.0 to 3.0% by weight |
| Nickel: | 0.0 to 3.0% by weight |
| Vanadium: | 0.0 to 1.0% by weight |
| Copper: | 0.0 to 2.0% by weight |

* * * * *